US009593563B2

(12) United States Patent
Johnsen et al.

(10) Patent No.: US 9,593,563 B2
(45) Date of Patent: Mar. 14, 2017

(54) METHOD AND APPARATUS FOR GENERATING STEAM FOR THE RECOVERY OF HYDROCARBON

(75) Inventors: Sten Egil Johnsen, Skien (NO); Leif Kåre Grønstad, Sannidal (NO); Carsten Frithjof Sørlie, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 120 days.

(21) Appl. No.: 14/350,025

(22) PCT Filed: Oct. 5, 2011

(86) PCT No.: PCT/EP2011/067419

§ 371 (c)(1),
(2), (4) Date: Jun. 12, 2014

(87) PCT Pub. No.: WO2013/050075

PCT Pub. Date: Apr. 11, 2013

(65) Prior Publication Data

US 2014/0305639 A1 Oct. 16, 2014

(51) Int. Cl.
*E21B 43/24* (2006.01)
*F01K 7/32* (2006.01)
(Continued)

(52) U.S. Cl.
CPC ..... *E21B 43/2406* (2013.01); *E21B 43/24* (2013.01); *F01K 7/32* (2013.01);
(Continued)

(58) Field of Classification Search
CPC ..... E21B 43/24; E21B 43/2406; E21B 36/00; E21B 43/168; E21B 43/2408; C10G 2300/805; C10G 47/32; C10G 2300/1033
See application file for complete search history.

(56) References Cited

U.S. PATENT DOCUMENTS 2,358,380 A 9/1944 Butzler
3,033,177 A 5/1962 Koch et al.
(Continued)

FOREIGN PATENT DOCUMENTS

CA 2 621 991 C 9/2010
CA 2 641 866 C 4/2011
(Continued)

OTHER PUBLICATIONS

Birrell et al., "Cyclic SAGD—Economic Implications of Manipulating Steam Injection Rates in SAGD Projects—Re-Examination of the Dover Project", Journal of Canadian Petroleum Technology, vol. 44, No. 1, Jan. 2005, pp. 54-58.
(Continued)

*Primary Examiner* — Zakiya W Bates
(74) *Attorney, Agent, or Firm* — Birch, Stewart, Kolasch & Birch, LLP

(57) ABSTRACT

The instant disclosure provides a method of generating steam for the recovery of hydrocarbon from a hydrocarbon producing system including (i) generating supercritical steam from water; (ii) converting the supercritical steam to a subcritical steam; and (iii) injecting the subcritical steam into the system.

34 Claims, 4 Drawing Sheets

(51) Int. Cl.

| | |
|---|---|
| ***F22B 37/48*** | (2006.01) |
| ***F22B 29/06*** | (2006.01) |
| ***F22B 37/26*** | (2006.01) |
| ***F22G 7/00*** | (2006.01) |

(52) U.S. Cl.
CPC ..... *F22B 29/067* (2013.01); *F22B 37/26* (2013.01); *F22B 37/48* (2013.01); *F22G 7/00* (2013.01)

(56) References Cited

U.S. PATENT DOCUMENTS

| | | | | |
|---|---|---|---|---|
| 3,377,994 | A | 4/1968 | Horne | |
| 4,061,553 | A | 12/1977 | Alexander et al. | |
| 4,344,485 | A | 8/1982 | Butler | |
| 4,465,026 | A | 8/1984 | Carberry | |
| 4,489,679 | A | 12/1984 | Holt | |
| 4,730,577 | A | 3/1988 | Houghton | |
| 4,975,238 | A | 12/1990 | Regan et al. | |
| 5,027,750 | A | 7/1991 | Boland et al. | |
| 5,776,413 | A | 7/1998 | Kamberger et al. | |
| 6,109,020 | A | 8/2000 | Liebig | |
| 6,343,570 | B1 | 2/2002 | Schmid et al. | |
| 6,655,322 | B1 | 12/2003 | Godwin et al. | |
| 6,675,747 | B1 | 1/2004 | Goidich et al. | |
| 6,733,636 | B1 | 5/2004 | Heins | |
| 6,988,549 | B1 | 1/2006 | Babcock | |
| 2004/0194735 | A1 | 10/2004 | Wood | |
| 2006/0032630 | A1 | 2/2006 | Heins | |
| 2007/0084418 | A1 | 4/2007 | Gurevich | |
| 2009/0133643 | A1 | 5/2009 | Suggett et al. | |
| 2010/0031653 | A1* | 2/2010 | Foppe | E21B 7/15 60/641.3 |
| 2010/0193444 | A1 | 8/2010 | Boodoo | |
| 2011/0017449 | A1 | 1/2011 | Berruti | |
| 2011/0226473 | A1* | 9/2011 | Kaminsky | E21B 43/24 166/272.3 |

FOREIGN PATENT DOCUMENTS

| | | | |
|---|---|---|---|
| DE | 197 36 88 | A1 | 3/1999 |
| DE | 10 2008 023 263 | A1 | 11/2009 |
| EP | 0 089 128 | A1 | 9/1983 |
| EP | 0 777 036 | A1 | 6/1997 |
| EP | 2 281 148 | B1 | 3/2012 |
| GB | 693330 | A | 6/1953 |
| GB | 1 499 504 | A | 2/1978 |
| GB | 1 509 557 | A | 5/1978 |
| JP | 3148501 | B2 | 3/2001 |
| JP | 2005-233531 | A | 9/2005 |
| WO | WO 01/83070 | A1 | 11/2001 |
| WO | WO 2007/100733 | A2 | 9/2007 |
| WO | WO 2009/105309 | A1 | 8/2009 |

OTHER PUBLICATIONS

Butler, "Thermal Recovery of Oil and Bitumen", Prentice Hall, 1991, p. 309.

Edmunds et al., "Economic Optimum Operating Pressure for SAGD Projects in Alberta", Journal of Canadian Petroleum Technology, vol. 40, No. 12, Dec. 2001, pp. 13-17.

Fanaritis et al., "Review of Once-Through Steam Generators", Journal of Petroleum Technology, Apr. 1965, pp. 409-416.

Madden Manufacturing, Inc., "Blowdown Tanks for Boilers", www.maddenmfg.com/blowdown-tanks-for-boilers.cfm, (publication date unknown—printed Apr. 17, 2014), 1 page.

Nessler et al., "Developements in HRSG Technology", The 7th Annual Industrial & Power Gas Turbine O&M Conference, Nov. 14-15, 2001, pp. 1-10.

Oil Sands Industry Update, Prepared by Alberta Economic Development, Mar. 2004, 53 pages.

Yee et al., "Flue Gas Injection Into a Mature SAGD Steam Chamber at the Dover Project (Formerly UTF)", Journal of Canadian Petroleum Technology, vol. 43, No. 1, Jan. 2004, pp. 54-61.

Tertzakian et al., "Canadian Oil and Gas Industry Competiveness and Financial Performance: A Study Prepared for the Canadian Association of Petroleum Producers", ARC Financial Corporation, Feb. 2003, pp. 1-31.

* cited by examiner

METHOD AND APPARATUS FOR GENERATING STEAM FOR THE RECOVERY OF HYDROCARBON

The present invention relates to a method of generating steam for the recovery of hydrocarbon and to a method of producing hydrocarbon from a hydrocarbon producing system using the afore-mentioned method of steam generation. The invention further relates to an apparatus for generating steam for the recovery of hydrocarbon and to a system for producing hydrocarbon from a hydrocarbon producing formation.

BACKGROUND

Heavy hydrocarbons, e.g. bitumen, represent a huge natural source of the world's total potential reserves of oil. Present estimates place the quantity of heavy hydrocarbon reserves at several trillion barrels, more than 5 times the known amount of the conventional, i.e. non-heavy, hydrocarbon reserves. This is partly because heavy hydrocarbons are generally difficult to recover by conventional recovery processes and thus have not been exploited to the same extent as non-heavy hydrocarbons. Heavy hydrocarbons possess very high viscosities and low API (American Petroleum Institute) gravities which makes them difficult, if not impossible, to pump in their native state.

Various different methods have been developed for recovering heavy hydrocarbons such as bitumen. Cold production techniques include mining, natural depletion, cold heavy oil production with sand (CHOPS) and vapour extraction (VAPEX). Thermal production techniques include steam assisted gravity drainage (SAGD), cyclic steam stimulation (CSS) and in situ combustion (ISC). SAGD and CSS both utilise steam to heat up hydrocarbon thereby reducing its viscosity to render it mobile. The use of steam in ISC is also common wherein it is often employed to heat up the formation to a high enough temperature to enable combustion to be initiated.

The method that is used most often commercially today for heavy hydrocarbon recovery from subterranean reservoirs is SAGD. In this method two horizontal wells are drilled approximately five meters vertically apart and steam, typically generated in a once through steam generator, is injected into the formation through the upper wellbore. The steam permeates the formation and reduces the viscosity of the heavy hydrocarbon (e.g. bitumen) present therein thereby enabling it to flow from the reservoir and into the lower well. From there it is pumped to surface facilities.

The mobilised hydrocarbon recovered at the surface is in the form of a mixture with water from condensed steam and formation water. Various minerals and inorganic salts, e.g. silica, iron, carbonates, are also dissolved or suspended in the mixture. These may, for example, derive from the water and/or the formation.

When the mobilised hydrocarbon is collected at the surface it is usually treated to separate the produced hydrocarbon from the water. Typically the water that is obtained from this separation process is recycled by using it for the generation of further steam in a steam generator. Usually, however, the water must first be purified to render it suitable for feeding to a boiler for steam generation. Otherwise the minerals and inorganic salts present in the water precipitate out to form deposits that stick to the heat surfaces of the boiler in a process often referred to as "fouling". The deposits form a thermal barrier on the heat surfaces and increase the temperature of the surfaces which ultimately reduces the strength of their material and their service lifetime. The deposits also reduce the heat transfer to water to generate steam thus reducing the quantity and quality of the steam subsequently produced by the steam generator. Boilers generally need to be taken out of operation at regular intervals for cleaning and maintenance to remove deposits created by fouling. The higher the degree of fouling the shorter the operational periods between cleaning and maintenance are.

To minimise the amount of fouling that occurs in a once through steam generator the quality of steam produced therefrom is usually limited to around 80% by weight. The presence of 20% water in liquid form in the steam means that drying out at the heat transfer surface is less likely to occur. As a result, the precipitation of solids on the pipe surfaces may be minimised. On the other hand, however, this means that 20% by weight of the water that is fed into the boiler is not converted to steam which represents a significant inefficiency. Moreover this water must ultimately be treated for recycling to the boiler or for disposal.

Various different methods may be employed to treat water recovered from hydrocarbon production and/or steam generation prior to recycling it for steam generation. Chemical means can, for example, be used to reduce water hardness and silica content. Evaporation can also be used although this is energy intensive. The effective treatment of large volumes of separated water from hydrocarbon recovery operations economically is therefore a challenge.

Additionally or alternatively the accumulation of minerals and salts on the heat transfer surfaces of a steam generator may be prevented or minimised by "blowing out" or "blowing down" a portion of the water produced from the hydrocarbon recovery operation and obtained in the hydrocarbon/water separation step. In this case the water for steam generation is usually supplemented with fresh water. The combined affect of consuming fresh water and blowing out waste water, e.g. to deep groundwater reservoirs, is significant. Even with care, it has an environmental impact.

A major problem associated with the use of steam in recovery of heavy hydrocarbons is therefore the supply of suitable water for steam generation in a steam generator, typically a once through steam generator. Fouling of steam generators leads to short service periods and high maintenance costs and reduces the quality of steam produced. The treatment of water from previous recovery operations to make it useable for steam generation is, however, costly and only partially effective. The use of large amounts of fresh water has a significant environmental impact as underground fresh water reservoirs are depleted and blow out water is stored underground.

There have been various different strategies developed to try to overcome these problems. US2009/0133643, for example, describes a method for steam generation for injection into a hydrocarbon reservoir that reduces the amount of boiler blowdown that requires treatment and/or disposal. In this method the blowdown from a first once through steam generator is fed directly (i.e. without purification) to a so-called blowdown boiler that produces further steam. The output of the blowdown boiler is dry saturated steam and a blowdown stream of reduced volume compared to that produced from the first steam generator. This therefore increases the total amount of steam produced from a given volume of water and correspondingly reduces the amount of blowdown for actual disposal. The once through steam generators used in US2009/0133643 and the conditions in which they are operated seem to be entirely conventional. Despite this US2009/0133643 states that its configuration does not lead to rapid fouling of the blowdown boiler as would be expected to result from the introduction of water comprising minerals and inorganic salts. No reason or explanation for this result is provided.

US2011/0017449 discloses a different approach wherein a once through steam generator is adapted to operate with high impurity water to provide steam having a quality of at least 80% by volume. The key to the methods disclosed in US2011/0017449 is the use in its once through steam generator of pipes having a bore with an inner surface having ribs that define a helical flow passage. The helical flow passage guides the water though the pipes, imparting a swirling motion thereto, which controls the concentrations of the impurities in the water. This reduces the likelihood that droplets of water form and avoids the generation of droplets having high concentrations of impurities that are prone to precipitation in the form a deposit, i.e. to fouling. As a result, water having much high levels of impurities can be used as a water supply for the once through steam generator.

On the other hand, however, this method requires the production of special pipes having the necessary interior configuration and then their incorporation into steam generators. Such modifications are significant and not easily undertaken. These pipes cannot be retrofitted into a boiler, rather they have to be installed by the manufacturer at the time the boiler is made.

A need therefore still exists for alternative methods for overcoming the problem of generating steam for recovery of heavy hydrocarbons that avoids or minimises the problem of fouling of steam generators. In particular methods are needed that do not require the use of extensive water purification treatments to enable the recycling of water recovered from hydrocarbon production for use in steam generation or significant amounts of fresh water to be regularly introduced.

It has now been discovered that these problems may be overcome by generating supercritical steam in a steam generator. The use of supercritical steam means that the heat transfer surfaces are mainly exposed to a flowing supercritical phase therefore the risk of drying out at the pipe surface with precipitate forming and sticking thereto (i.e. fouling occurring) is significantly reduced. Moreover because the steam is in supercritical form the pipes in the boiler may have a small diameter and therefore high flow rate. This additionally helps to prevent fouling and advantageously provides a large heat transfer surface for efficient heat transfer.

SUMMARY OF INVENTION

Viewed from a first aspect the present invention provides a method of generating steam for the recovery of hydrocarbon from a hydrocarbon producing system comprising:

(i) generating supercritical steam from water;
(ii) converting said supercritical steam to a subcritical steam; and
(iii) injecting said steam into said system.

Viewed from a further aspect the present invention provides a method for generating steam for the recovery of hydrocarbon from a hydrocarbon producing system comprising:

(i) generating subcritical steam from water;
(ii) separating said subcritical steam into water and steam;
(iii) generating supercritical steam from said separated water;
(iv) converting said supercritical steam to a subcritical steam;
(v) optionally combining the steam produced in steps (ii) and (iv); and
(vi) injecting said subcritical steam into said system.

Viewed from a further aspect the present invention provides a method of producing hydrocarbon from a hydrocarbon producing system comprising:

(a) generating steam by a method as hereinbefore described; and
(b) using said stream in a method of producing hydrocarbon from said formation.

Viewed from a yet further aspect the present invention provides an apparatus for generating steam for the recovery of hydrocarbon from a hydrocarbon producing system comprising:

(i) an inlet for water;
(ii) a supercritical steam boiler connected to said inlet for producing supercritical steam;
(iii) an expansion unit connected to said supercritical steam boiler for converting said supercritical steam to subcritical steam; and
(iv) an outlet connected to said expansion unit for delivery of the steam to said system.

Viewed from a still further aspect the present invention provides an apparatus for generating steam for the recovery of hydrocarbon from a hydrocarbon producing system comprising:

(i) an inlet for water;
(ii) a steam boiler connected to said inlet for producing subcritical steam;
(iii) a separator connected to said steam boiler for separating water and steam;
(iv) a supercritical steam boiler connected to said separator for producing supercritical steam from separated water;
(v) an expansion unit connected to said supercritical steam boiler for converting said supercritical steam to subcritical steam;
(vi) an outlet connected to said separator for delivery of the steam to said system; and
(vii) an outlet connected to said expansion unit for delivery of the steam to said system.

Viewed from a still further aspect the present invention provides a system for producing hydrocarbon from a hydrocarbon producing formation comprising:

(i) an apparatus as hereinbefore described;
(ii) a well arrangement connected to said outlet of the apparatus; and
(iii) a means for the recovery of hydrocarbon.

Viewed from a still further aspect the present invention provides a method of cleaning an apparatus for generating steam comprising:

(i) generating supercritical steam from water;
(ii) injecting $O_2$ into said supercritical steam; and
(iii) pumping said $O_2$-containing supercritical steam through said apparatus.

DESCRIPTION

The term supercritical steam is used herein to describe steam having a temperature and pressure at, or above, the critical point of water. The critical point describes the endpoint of the liquid-vapour coexistence line on the phase diagram for water. It occurs at a temperature of 374° C. (647 K) and a pressure of 22.1 MPa (218 atm). Supercritical steam does not comprise separate water (liquid) and steam (vapour) phases. Supercritical steam is known to have interesting properties, for example, it has high diffusion rates and low viscosities and acts as a powerful solvent for many substances.

The term subcritical steam is used herein to describe steam having a temperature and/or pressure that is lower that the critical point for water. Subcritical steam often comprises a mixture of steam (gas phase $H_2O$) and water (liquid phase $H_2O$). The amount of each phase present depends on the temperature and pressure of the subcritical steam.

As used herein the term "steam quality" refers to the percentage of steam (gas phase) by weight present in a steam and water mixture, e.g. in subcritical steam. A steam quality of 100% indicates that the steam is dry, i.e. absent of free water in the liquid phase. A steam quality of 50% indicates that the steam is 50% steam (gas phase) and 50% water (liquid phase).

As used herein, the term "hydrocarbon" is used to refer to a combination of different hydrocarbons, i.e. to a combination of various types of molecules that contain carbon atoms and, in many cases, attached hydrogen atoms. "Hydrocarbon" may comprise a large number of different molecules having a wide range of molecular weights. Generally at least 90% by weight of the hydrocarbons consist of carbon and hydrogen atoms. Up to 10% by weight may be present as sulfur, nitrogen and oxygen as well as metals such as iron, nickel and vanadium (i.e. as measured sulfur, nitrogen, oxygen or metals).

The methods, apparatus and system of the present invention are particularly useful in the recovery of heavy hydrocarbons. Heavy hydrocarbons comprise a greater proportion of hydrocarbons having a higher molecular weight than a relatively lighter hydrocarbon mixture. As used herein heavy hydrocarbons preferably have an API gravity of less than about 15°, preferably less than 12°, still more preferably less than 10°, e.g. less than 8°. It is particularly preferred if the API gravity of the heavy hydrocarbons to be recovered is from about 5° to about 15°, more preferably from about 6° to about 12°, still more preferably about 7° to about 12°, e.g. about 7.5-9°. Examples of heavy hydrocarbons that typically have API gravities falling in these ranges are bitumens, tars, oil shales and oil sand deposits.

As used herein the term hydrocarbon producing system is used to refer to a system comprising an apparatus for the generation of steam, a well arrangement connected to the outlet of the apparatus and a means for the recovery of hydrocarbon.

As used herein the term "steam for the recovery of hydrocarbon" refers to steam for use in any method of extracting hydrocarbon from a hydrocarbon producing system. The methods may be based solely on steam or may utilise steam in conjunction with other agents, e.g. liquid hydrocarbons, gaseous hydrocarbons and non-hydrocarbon gases such as air and nitrogen. Representative examples of preferred methods for recovery of hydrocarbon from a hydrocarbon producing system utilising steam include SAGD, CSS, hot solvent extraction, VAPEX and ISC. These methods may be used alone or in combination, e.g. with other methods such as fracturing. Preferably the methods of generating steam of the present invention are for the recovery of hydrocarbon from a hydrocarbon producing system by SAGD or hot solvent extraction.

As described above, SAGD is often used to facilitate the recovery of heavy hydrocarbons. In this method two horizontal wells, typically referred to as an injection well and a producer well, are drilled into the reservoir, vertically separated by, e.g. 2-10 meters. This group of two wells is typically referred to as a well pair or a SAGD well pair. A mobilising medium, typically steam, is injected into the upper injection well, flows outward, contacts the hydrocarbon above it, condenses and transfers its latent heat to the hydrocarbon. This heating reduces the viscosity of the hydrocarbon, its mobility increases and it flows due to gravity to the lower producer well from where it can be produced.

The first step of the method of the invention comprises generating supercritical steam from water. The hydrocarbon produced at the surface of a formation from the recovery of hydrocarbon comprises water, e.g. from condensed steam and from formation water. Preferably the water used to generate supercritical steam comprises water obtained from hydrocarbon recovery operations. The amount of water present in produced hydrocarbon is highly variable and depends, for example, on the type of formation, the type of recovery operation being carried out and the quality of the steam injected into the formation. The amount of water present in the hydrocarbon may be, for example, 1-80% by volume, more preferably 5-60% by volume, still more preferably 10-50% by volume, e.g. 15 to 45% by volume. The water present typically comprises minerals and inorganic salts in dissolved and/or suspended form.

If the water produced along with hydrocarbon at the surface is not recycled for the generation of steam it has to be disposed of in an environmentally safe manner. This usually requires the water to be purified to a certain level and then injected into a subterranean reservoir. Water that is disposed of, rather than recycled, is called blow down or blow out water. Blow down water is highly undesirable from an economic and environmental point of view. Thus in preferred methods of the present invention, at least 90% by volume, more preferably at least 95% by volume, still more preferably at least 98% by volume of the water obtained from hydrocarbon recovery operations is used to generate supercritical steam. In particularly preferred methods substantially all of the water (i.e. 100% by volume) of the water recovered from hydrocarbon recovery operations is used to generate supercritical steam. This means that the volume of blow down in minimised. Preferably the less than 10% by volume of the water obtained from hydrocarbon recovery operation is blown down, more preferably less than 5% by volume.

An advantage of the methods of the present invention employing supercritical steam is that the water used for steam generation does not need to be purified to as high a level as when subcritical steam is generated in a boiler. This is beneficial because the cost of the purification step is decreased, e.g. because fewer chemicals are needed. Thus when water obtained from hydrocarbon recovery operations is used to generate supercritical steam it only needs to be treated to decrease the concentration of hydrocarbon to less than 5 ppm wt, more preferably less than 50 ppm wt, still more preferably less than 500 ppm wt, yet more preferably less than 1000 ppm wt. The water may of course be treated to reduce the concentration of hydrocarbon in the water to essentially zero (e.g. to 1 ppm) but this is not necessary.

Similarly when water obtained from hydrocarbon recovery operations is used to generate supercritical steam it only needs to be treated to decrease the concentration of total dissolved solids (TDS) to less than 8500 ppm wt, more preferably less than 15,000 ppm wt, still more preferably less than 30,000 ppm wt. The water may of course be treated to reduce the concentration of TDS in the water to essentially zero (e.g. to 1 ppm) but this is not necessary.

Similarly when water obtained from hydrocarbon recovery operations is used to generate supercritical steam it only needs to be treated to decrease the concentration of silica to less than 50 ppm wt, more preferably less than 250 ppm wt, still more preferably less than 500 ppm wt, yet more preferably less than 1000 ppm wt. The water may of course be treated to reduce the concentration of silica in the water to essentially zero (e.g. to 1 ppm wt) but this is not necessary.

Similarly when water obtained from hydrocarbon recovery operations is used to generate supercritical steam it only needs to be treated to decrease the concentration of $CaCO_3$ to less than 1 ppm wt, more preferably less than 10 ppm wt, still more preferably less than 100 ppm wt, yet more preferably less than 500 ppm wt. The water may of course be treated to reduce the concentration of inorganic salts in the water to essentially zero (e.g. to 0.01 ppm) but this is not necessary.

Preferably the pH of the water used to generate supercritical steam is in the range 5 to 9, more preferably 6-8.

The methods used to treat the water recovered from hydrocarbon recovery to decrease the concentration of, e.g. hydrocarbon, silica, inorganic salts (e.g. $CaCO_3$), are conventional in the art. Representative examples of treatment methods include chemical treatment and evaporation. Examples of chemical treatments that may be employed include a warm lime softener, which removes hardness and some silica and a weak acid cation (WAC) system, which removes hardness. One or more filters may be used to remove suspended solids. A decarbonator may be employed to remove $CO_2$. An electrodeionisation treatment unit and/or an evaporator may be used to remove hardness.

Alternatively or additionally the water used to generate supercritical steam may comprise fresh water, i.e. water that has not been obtained from a hydrocarbon recovery operation. More preferably the water used to generate supercritical steam in the methods of the invention comprises water obtained from hydrocarbon recovery operations and fresh water. Fresh water may be needed to maintain the required volume of water for supercritical steam generation because, e.g. some water is lost to the formation, and/or to make up for water that is blown off. Preferably the water used to generate supercritical steam comprises less than 10% by volume fresh water, still more preferably less than 5% by volume fresh water, still more preferably less than 3% by volume fresh water, e.g. 1 or 0% by volume fresh water.

As hereinbefore described, and contrary to conventional practice, the methods of the present invention allow the water used to generate supercritical steam to comprise substantial concentrations of impurities such as hydrocarbon, silica and inorganic salts (e.g. $CaCO_3$). Thus the water used to generate supercritical steam, e.g. water recovered from hydrocarbon recovery operations and/or fresh water, preferably comprises at least one of:

| | |
|---|---|
| Silica | 50 ppm wt or higher, preferably 50 to 1000 ppm wt, e.g. 250-500 ppm wt |
| TDS | 8500 ppm wt or higher, preferably 8500-30,000 ppm wt, e.g. 10,000-15,000 ppm wt |
| Hydrocarbon | 5 ppm wt or higher, preferably 5-1000 ppm wt, e.g. 50-500 ppm wt |
| $CaCO_3$ | 1 ppm wt or higher, preferably 1-500 ppm wt, e.g. 10-100 ppm wt |

In particularly preferred methods of the invention, the water used to generate supercritical steam comprises at least two of the afore-going, still more preferably at least three of the afore-going. Particularly preferably the water used to generate supercritical steam comprises all of the afore-going.

In preferred methods of the present invention, the supercritical steam is close to the critical point for water. Thus in a preferred method, the temperature of the supercritical steam is more than 380° C., more preferably more than 400° C., still more preferably more than 450° C. Preferably the temperature is less than 900° C., more preferably less than 850° C., still more preferably less than 700° C. Preferably the temperature of the supercritical steam is in the range 380-800° C., more preferably 400-750° C. The use of a temperature just above the critical temperature for water results in the generation of supercritical steam without fouling with minimum energy useage.

In further preferred methods of the present invention, the pressure of the supercritical steam is between about 22.2-50 MPa, more preferably 23-45 MPa, still more preferably 25-40 MPa, e.g. 30-35 MPa. Especially preferred are methods wherein the supercritical steam is at a temperature between 380-800° C. and a pressure of 22.2-50 MPa, still more preferably a temperature between 400-750° C. and a pressure of 25-45 MPa.

In the methods of the present invention the supercritical steam is generated from water in a once-through steam generator. Suitable steam generators are commercially available. Benson boilers that are once-through supercritical steam generators, which are commercially available, e.g. from Siemens Power Generation, LMW (Leningrad Metal Works), G. E. Power Systems, Toshiba Corporation, Alstom and Mitsubishi Heavy Industries, are suitable for use in the methods of the invention. A significant advantage of the methods of the present invention is that steam (in gas form) generation at the heating surfaces of the boiler are largely avoided. The possibility of the heating surface drying out is therefore also avoided. As a result the chances of precipitation, e.g. of inorganic salts, occurring at the heat surface and the precipitate sticking to the heat transfer surface is greatly reduced.

Without wishing to be bound by theory, it is believed that although some precipitation of impurities present in the water used to generate supercritical steam may occur as high pressure, high temperature water is converted to supercritical steam that these precipitates do not tend to stick to the heat transfer surfaces of the steam generator. This is partly because the supercritical steam is an excellent solvent, generally better than water, and thus is able to dissolve or suspend significant quantities of impurities and partly because the flow rate of supercritical steam in the steam generator is generally high and is turbulent. This discourages any solids that do precipitate from the supercritical steam from sticking, i.e. the flow will tend to carry them through the generator and prevent them from sticking to heat transfer surfaces. Thus in preferred methods of the present invention the flow of supercritical steam in the steam generator is turbulent.

In preferred methods of the invention, oxygen is added to the supercritical steam once it has been generated. Oxygen may, for example, be added to supercritical steam at one or more positions during its transit from a steam generator to an expansion unit. Oxygen may be added into the flow by injection through a valve. If oxygen is added to supercritical steam, it leads to the combustion of any organics, e.g. hydrocarbon, present therein. The addition of oxygen to supercritical steam therefore serves to remove impurities present therein and generate energy. The energy may be used to power any other device that is part of the system.

Optionally the energy may be captured and used by the steam generator. The amount of oxygen added will generally be that needed to oxidise all of the hydrocarbon impurities present in the supercritical steam. When oxygen is added to supercritical steam, preferably the concentration of hydrocarbon in the supercritical steam is reduced to 1-1,000 ppm, more preferably 5-500 ppm, still more preferably 10-250 ppm. Preferably the concentration of hydrocarbon in supercritical steam is reduced to these levels before the hydrocarbon reaches an expansion unit.

In preferred methods of the present invention, the supercritical steam is converted to subcritical steam in an expansion unit. The unit may be, for example, a valve or a turbine. Preferably the unit is a turbine as this minimises the level of noise and vibration in the system. Suitable expansion turbines are commercially available, e.g. from Siemens. In preferred units, it is possible to control the pressure and temperature of the steam throughout the process. Thus in preferred methods the supercritical steam is converted to subcritical steam having a pressure and/or temperature within a predetermined range. This is highly advantageous because the conditions of the subcritical steam can be tailored to suit the needs of the formation and hydrocarbon recovery operation in which the steam is going to be used. Usually pressure will be gradually decreased. Usually temperature will be gradually decreased. More preferably the pressure and temperature of the steam are gradually decreased at the same time.

In some preferred methods of the invention, the supercritical steam is converted to subcritical steam that is dry. Such a conversion is advantageous because it means that all of the water fed to the steam generator is converted to steam for recovery of hydrocarbon, i.e. there is no water to be treated for disposal from the steam generation step. This conversion may be achieved by closely controlling the rate at which the supercritical steam flows into the expansion unit and the rate at which the temperature and pressure of the steam are reduced during the expansion process.

In other methods, however, it may be advantageous to convert the supercritical steam into subcritical steam that comprises a steam and water mixture. The amount of steam generated is preferably 80-99% by volume, more preferably 85-98% by volume, still more preferably 90-97% by volume. Correspondingly the amount of water generated is preferably 20-1% by volume, more preferably 2-15% by volume, still more preferably 3-10% by volume.

During the conversion of supercritical steam to subcritical steam, energy is released. In preferred methods, this energy is captured. Preferably the energy is used to drive the generation of steam.

Following the conversion of supercritical steam to subcritical steam, the subcritical steam preferably passes through at least one separator, e.g. one separator. The separator preferably separates the steam from impurities. If the subcritical steam comprises a water and steam mixture, the subcritical steam is preferably separated into steam and water. In this case, the impurities will normally be present in the water. The use of water may therefore be a convenient way of removing impurities. Preferably water and/or impurities is removed from the steam prior to its injection into the system.

The water used to generate supercritical steam in the methods of the present invention generally comprises higher than conventional levels of impurities, e.g. its hydrocarbon content and TDS content may be in the ranges discussed above. The subcritical steam injected into the formation does not, however, generally comprise significant levels of impurities. In preferred methods of the invention the impurities are removed from said subcritical steam prior to its injection into said system. This is an important advantage of the methods of the invention since if steam comprising high levels of impurities is injected into the system then the hydrocarbon and water produced from the system would be expected to correspondingly comprise high levels of impurities. Thus when the water is used for the generation of further supercritical steam, the level of impurities present therein would be even higher still. In other words, the level of impurities being recycled through the system would continually increase.

The impurities present in the subcritical steam may be removed by any method conventional in the art. For example, when the supercritical steam is converted to subcritical steam that is dry, the impurities may be removed by their deposition as solids in the expansion unit. In the absence of water, solids will tend to precipitate out from the supercritical steam during its conversion to subcritical steam. These solids may be removed intermittently or continuously from the expansion unit, e.g. by the addition of water.

When the supercritical steam is converted to subcritical steam that comprises a steam and water mixture, the impurities are generally concentrated in the water. Impurities may therefore be removed by separation of water from the steam, e.g. water may be removed via an outlet in the bottom of the separator. Such separators are currently used to separate 80% quality steam prior to its injection in SAGD recovery operations and are therefore known in the art. In preferred methods, the water separated from the steam comprises at least 90%, more preferably at least 95% by weight of the hydrocarbon present in the water used to generate the steam. In other preferred methods, the water separated from the steam comprises at least 90%, more preferably at least 95% by weight of the TDS present in the water used to generate the steam. This is a significant benefit of this conversion process.

The water that is separated from the steam may be used to generate supercritical steam. More often, however, the water separated from the steam is not recycled. Preferably, and regardless of its intended use, the water separated from the steam is purified. Optionally the purified water is then disposed of. The method of the present invention may be used in combination with a conventional (i.e. non supercritical) system for generating steam. A preferred method comprises:

(i) generating subcritical steam from water;
(ii) separating said subcritical steam into water and steam;
(iii) generating supercritical steam from said separated water;
(iv) converting said supercritical steam to a subcritical steam;
(v) optionally combining the steam produced in steps (ii) and (iv); and
(vi) injecting said subcritical steam into said system.

Preferably the subcritical steam is generated in step (i) in a once-through steam generator. Preferably the subcritical steam is separated in step (ii) in a separator.

The water used to generate the subcritical steam in step (i) may be fresh water, water obtained from recovery of hydrocarbons or mixtures thereof. Preferably the water is as hereinbefore defined for the generation of supercritical steam.

As described above, the generation of subcritical steam is typically associated with the production of steam (gas phase) and water (liquid phase). It is necessary to operate steam boilers generating subcritical steam under conditions that yield such a mixture in order to minimise fouling of the boiler. A particular advantage of the methods of the present invention, however, is that the water separated from the subcritical steam can be used as feedwater for the generation of further steam, via supercritical steam, as hereinbefore defined.

Preferably the separated water used to generate supercritical steam in step (iii) is not purified. This means that costs are minimised and also that no water is lost. In some methods, substantially all of the water used in the generation of supercritical steam is water separated from subcritical steam generation. In other methods, the water separated from subcritical steam generation is mixed with water obtained from hydrocarbon recovery operations and/or fresh water. In this latter case, the water separated from subcritical steam generation is preferably mixed with water obtained from hydrocarbon recovery operations.

Preferably the water used to generate supercritical steam in step (iii) comprises at least one of:

| | |
|---|---|
| Silica | 50 ppm wt or higher, preferably 50 to 1000 ppm wt, e.g. 250-500 ppm wt |
| TDS | 8500 ppm wt or higher, preferably 8500-30,000 ppm wt, e.g. 10,000-15,000 ppm wt |
| Hydrocarbon | 5 ppm wt or higher, preferably 5-1000 ppm wt, e.g. 50-500 ppm wt |
| $CaCO_3$ | 1 ppm wt or higher, preferably 1-500 ppm wt, e.g. 10-100 ppm wt |

The steam obtained from the above described methods is injected into the hydrocarbon producing system. The quality of the steam is preferably at least 75% by weight, more preferably at least 80% by weight, still more preferably at least 90% by weight. The quality of the steam may, however, be as high as 100% by weight. The higher the quality of the steam injected into the hydrocarbon producing system, the lower the amount of water produced in combination with hydrocarbon. The generation and injection of high quality steam is therefore advantageous.

In preferred methods of the present invention, the temperature of the subcritical steam at the point of injection is more than 200° C., more preferably more than 250° C., still more preferably more than 300° C. Preferably the temperature of the subcritical steam is less than 500° C., more preferably less than 400° C. and still more preferably less than 350° C. Preferably the temperature of the subcritical steam is in the range 150-500° C., more preferably 200-350° C.

In further preferred methods of the present invention, the pressure of the subcritical steam is between about 0.5-22.0 MPa, more preferably 3-20 MPa, still more preferably 4-10 MPa. Especially preferred are methods wherein the subcritical steam is at a temperature between 150-500° C. and a pressure of 0.5-22.0 MPa, still more preferably a temperature between 200-350° C. and a pressure of 1.5-20 MPa.

The subcritical steam may be injected into the hydrocarbon producing system using conventional equipment and apparatus. Generally the subcritical steam is injected into the hydrocarbon system via pipes positioned in well arrangements. The well arrangement will vary depending on the recovery operation in use and/or on the nature and location of the hydrocarbon producing system.

In preferred methods of the invention, the subcritical steam is used in recovery of hydrocarbon by steam assisted gravity drainage. In this case, the subcritical steam is usually injected into a well arrangement via an injector well. This is described in more detail below.

The methods of the present invention are carried out in an apparatus comprising:

(i) an inlet for water;
(ii) a supercritical steam boiler connected to said inlet for producing supercritical steam;
(iii) an expansion unit connected to said supercritical steam boiler for converting said supercritical steam to subcritical steam; and
(iv) an outlet connected to said expansion unit for delivery of said supercritical steam to said system.

A preferred apparatus further comprises a separator in between the expansion unit and the outlet for separating steam and water and/or impurities so that the subcritical steam passes through the separator before it is delivered to the system. Preferably an inlet of the separator is connected to an outlet of the expansion unit. Preferably an outlet of the separator is connected to the apparatus outlet for delivery of steam. The inclusion of a separator is advantageous because it means that if supercritical steam is converted to subcritical steam comprising a steam and water mixture as described above that the water can easily be removed along with impurities. Preferably therefore the separator further comprises a water outlet. Still more preferably this water outlet is connected to a water purifier. The quality of steam injected to the hydrocarbon system tends to be higher when such a separator is present.

As described above, the methods of the present invention may be combined with a conventional (i.e. non-supercritical) method for the generation of steam. In this case the apparatus preferably comprises:

(i) an inlet for water;
(ii) a steam boiler connected to said inlet for producing subcritical steam;
(iii) a separator connected to said steam boiler for separating water and steam;
(iv) a supercritical steam boiler connected to said separator for producing supercritical steam from separated water;
(v) an expansion unit connected to said supercritical steam boiler for converting said supercritical steam to subcritical steam;
(vi) an outlet connected to said separator for delivery of the steam to said system; and
(vii) an outlet connected to said expansion unit for delivery of the steam to said system.

In a preferred apparatus the steam boiler is a once-through steam generator. In a particularly preferred apparatus the supercritical steam boiler is connected directly to said separator. This advantageously means that the water separated from the steam boiler is used, without purification, to generate steam via the supercritical steam boiler.

In preferred apparatus of the present invention, the supercritical steam boiler is a once through steam generator. In further preferred apparatus the expansion unit is a valve or a turbine.

A further preferred apparatus comprises a tank that is supplied with water from the water purifier. Preferably the tank is fluidly connected to the inlet of the apparatus.

The apparatus may comprise more than one expansion unit and/or more than one separator. In this case the supercritical steam boiler may be connected to the plurality of expansion units in a parallel arrangement. Usually the number of separators will be the same as the number of expansion units so they can be connected serially, but this is not necessarily the case. A plurality of expansion units could be connected to, for example, a single separator. The various possible arrangements are well known to the skilled man.

The apparatus may comprise more than one steam boiler per supercritical steam boiler. In this case the supercritical steam boiler may, for example, be connected to a plurality of steam boilers and their associated separators in a parallel arrangement. Although a parallel arrangement is preferred, the apparatus may also comprise one steam boiler per supercritical steam boiler in a serial arrangement.

The various components of the above-described apparatus are commercially available. An example of a suitable supercritical steam boiler is a Benson boiler that is commercially available from Siemens Power Generation, LMW (Leningrad Metal Works), G. E. Power Systems, Toshiba Corporation, Alstom and Mitsubishi Heavy Industries. An example of a suitable expansion unit is an expansion turbine that is commercially available from Siemens Power Generation. Alternatively the expansion unit may be a valve, e.g. an expansion valve. Suitable steam separators and steam boilers are commercially available.

The methods and apparatus of the present invention have numerous advantages over conventional methods. These include:

- Reduction in the level of fouling in steam generators which means that the cost of maintenance is reduced and down time is decreased;
- Reduction in the degree of water purification required as water comprising higher impurity levels can be fed to the steam generator wherein the supercritical steam and its flow prevents their deposition. Impurities are removed in the separator;
- Reduction in the volume of water to be purified as higher quality steam is injected into the hydrocarbon producing system;
- Reduced amount of blow down water and concomitant reduced amount of fresh water required. Together these factors significantly decrease the environmental impact of steam generation.

The methods and apparatus of the present invention may also be advantageously used in a method of cleaning an apparatus for generating steam and in particular for removing hydrocarbon from the apparatus. In this method supercritical steam is preferably generated by a method as hereinbefore defined. Instead of transporting the supercritical steam to an expansion unit, however, oxygen is added to the supercritical steam and the resulting $O_2$ containing supercritical steam is used for cleaning. The $O_2$ present in the supercritical steam will combust any organics it encounters, e.g. hydrocarbons adhered to heating element or pipe surfaces. The provision of $O_2$ in supercritical steam greatly reduces the risk of explosion.

The $O_2$ is preferably added to the supercritical steam after the steam has been generated and it has left the steam generator. Oxygen may be added into the flow by injection through a valve. The amount of oxygen added will vary depending on how much hydrocarbon is present in the apparatus to be cleaned. The amount of oxygen added will generally be enough to oxidise substantially all the hydrocarbon impurities present in the apparatus, preferably in a single pass through the apparatus. The $O_2$-containing supercritical steam may, however, be pumped through the apparatus to be cleaned a plurality of times.

The supercritical steam for cleaning may be generated in a separate apparatus to the apparatus to be cleaned. In this case, piping is preferably used to convey the supercritical steam to the apparatus to be cleaned. Preferably oxygen is added to the supercritical steam during its transit between the apparatus in which the steam is generated and the apparatus to be cleaned, e.g. via a valve.

Alternatively the supercritical steam for cleaning may be generated in the apparatus to be cleaned. Preferably the apparatus is as hereinbefore defined. In this case the apparatus preferably comprises a pipe for conveying supercritical steam to the inlet of the supercritical steam boiler. Preferably oxygen is added to the supercritical steam during its transit to the inlet of the supercritical steam boiler, e.g. via a valve. Preferably the apparatus further comprises a pipe for conveying $O_2$ containing supercritical steam to the separator.

The apparatus of the present invention is preferably incorporated into a system for producing hydrocarbon from a hydrocarbon producing formation, preferably by SAGD. The arrangement comprises:

(i) an apparatus as hereinbefore described;
(ii) a well arrangement connected to said outlet of the apparatus; and
(iii) a means for the recovery of hydrocarbon.

The term well arrangement is used to refer to an ordered grouping or organised structure of a number of wells within a reservoir. The term well refers to a hole drilled into a reservoir for use in the recovery of hydrocarbons. Preferably the well arrangement of the system of the present invention comprises:

i) a first steam assisted gravity drainage (SAGD) well pair;
ii) a second steam assisted gravity drainage (SAGD) well pair; and preferably
iii) an infill well, wherein said infill well is located in between said first and second SAGD well pairs.

Each SAGD well pair preferably comprises an injector well and a producer well. Preferably the injector well comprises a substantially horizontal section. Preferably the producer well comprises a substantially horizontal section. Preferably the substantially horizontal sections of each of these wells are in the hydrocarbon-containing portion of the reservoir. Each of these wells also preferably comprises a further section, typically a substantially vertical section, which extends from the horizontal section to the surface. This further, e.g. vertical, section is preferably integral with the horizontal section. This enables steam to be injected into, and hydrocarbon and water to be pumped out of, the wells to the reservoir surface.

In preferred SAGD well pairs for use in the present invention the producer well is located substantially underneath the injector well of its pair. The vertical distance between an injector well and a producer well is typically in the range 5-20 m.

Preferably the SAGD well pairs are parallel to each other and located at the same depth ±10 m, more preferably ±5 m, e.g. at the same depth.

The horizontal separation between the producer wells of the SAGD well pairs will generally be 50 to 200 m, more preferably about 75 to 150 m, e.g. about 100 m. Correspondingly the horizontal separation between the injector wells of the SAGD well pairs will generally be 50 to 200 m, more preferably about 75 to 150 m, e.g. about 100 m.

The well arrangements preferably employed by the methods of the present invention comprise an infill well. The main purpose of the infill well is to capture mobilised hydrocarbon to enable it to be pumped to the surface. The infill well therefore preferably comprises a substantially vertical section and a substantially horizontal section. Preferably the substantially horizontal section is integral with the substantially vertical section, i.e. they form a continuous well. Preferably hydrocarbon is recovered from the infill well.

The substantially vertical section of the infill well preferably enables fluids to be pumped out of the system. Thus the substantially vertical section preferably extends to the reservoir surface. The substantially horizontal section of the infill well preferably enables hydrocarbon to be efficiently collected. Thus preferably production tubing is provided in at least part of the substantially horizontal section of the infill well.

The substantially horizontal section of the infill well preferably extends the majority of the length of between the producer wells of the SAGD well pairs. Preferably the substantially horizontal section of the infill well extends at least 50% of the length between the producer wells of the SAGD well pairs, still more preferably at least 70% of the length, still more preferably at least 80% of the length, yet more preferably at least 85% of the length.

The substantially horizontal section of the infill well is preferably substantially parallel to the producer wells of the SAGD well pair. Particularly preferably the substantially horizontal section of the infill well is at approximately the same depth as the producer wells of the SAGD well pair.

The means for the recovery of hydrocarbon may be any means conventional in the art. This will include pipes, pumps, liners, casings, screens etc. The skilled man is readily aware of the equipment necessary.

DETAILED DESCRIPTION OF PREFERRED EMBODIMENTS

Figure 1A:
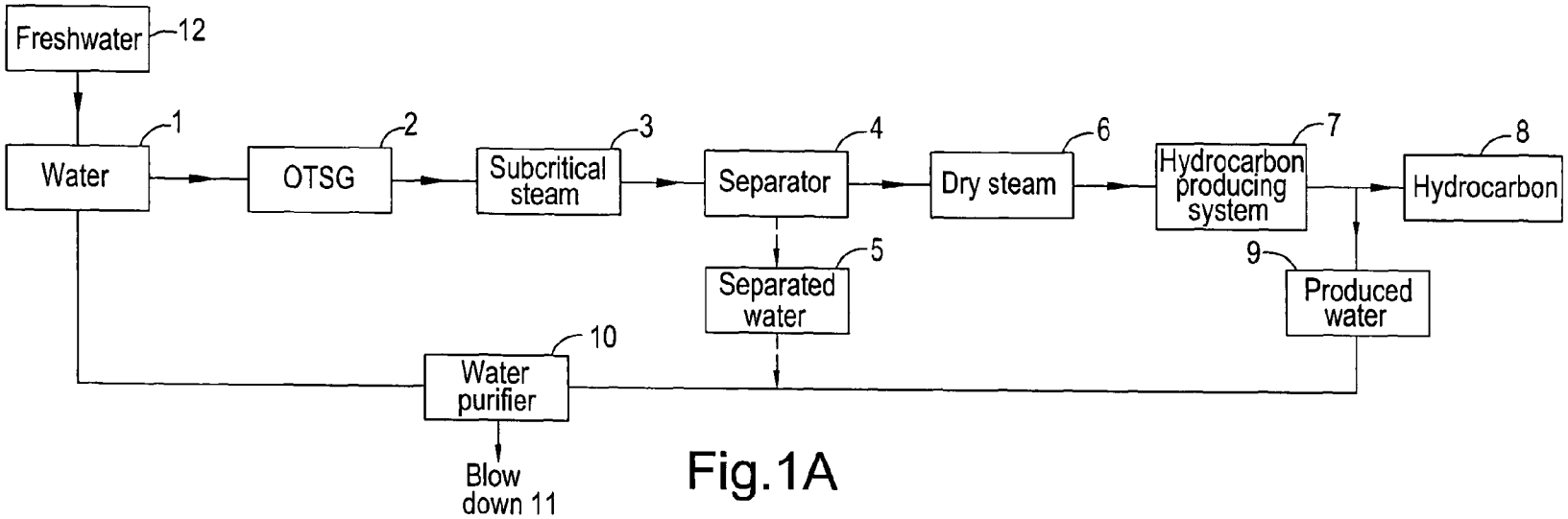
FIG. 1*a* is a schematic diagram showing the prior art method of steam generation for hydrocarbon recovery and FIG. 1*b* is a schematic diagram of a method of steam generation for hydrocarbon recovery according to the present invention.
Figure 1B:
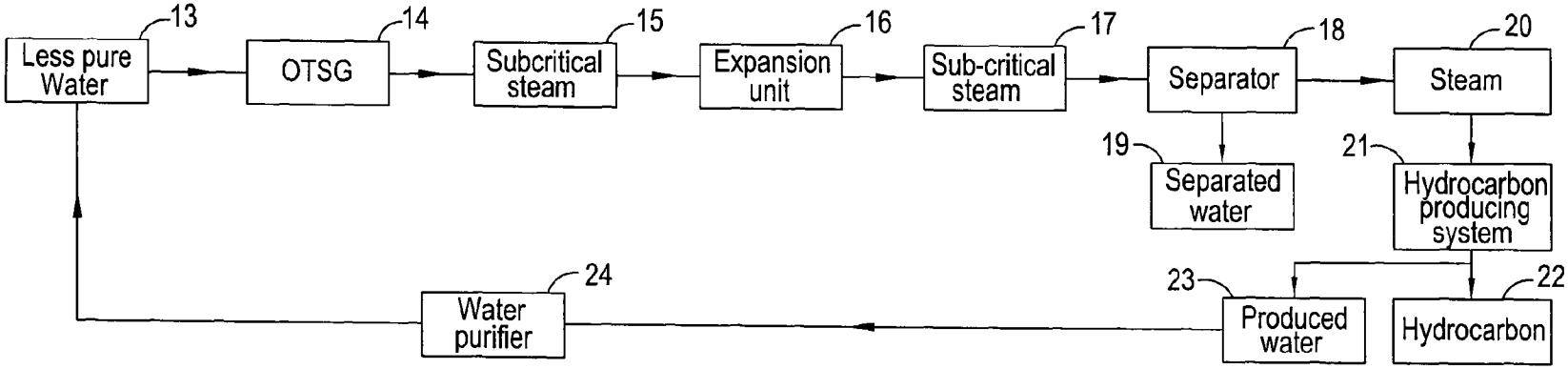
Figure 2:
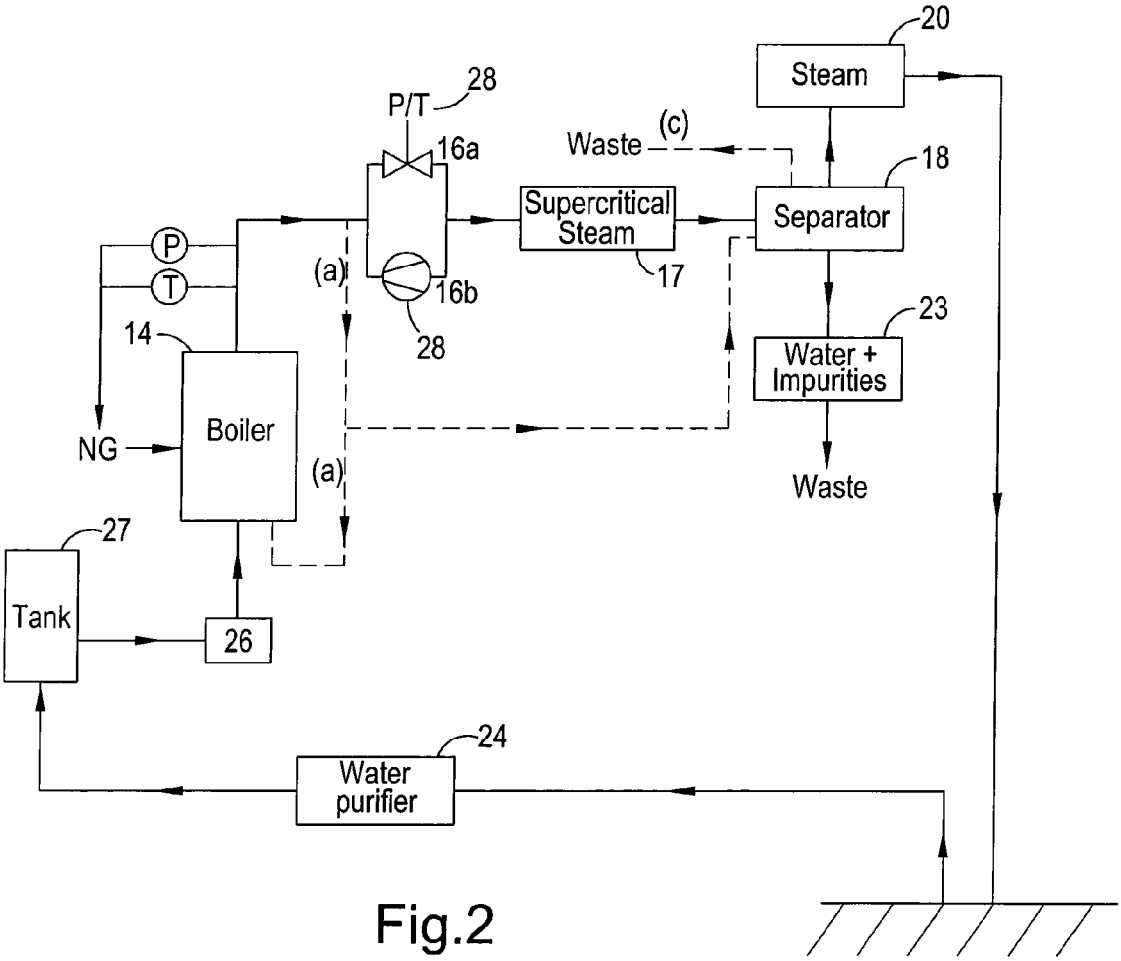
FIG. 2 is a schematic diagram of an apparatus of the present invention which also shows a method of cleaning an apparatus for generating steam.
Figure 3:
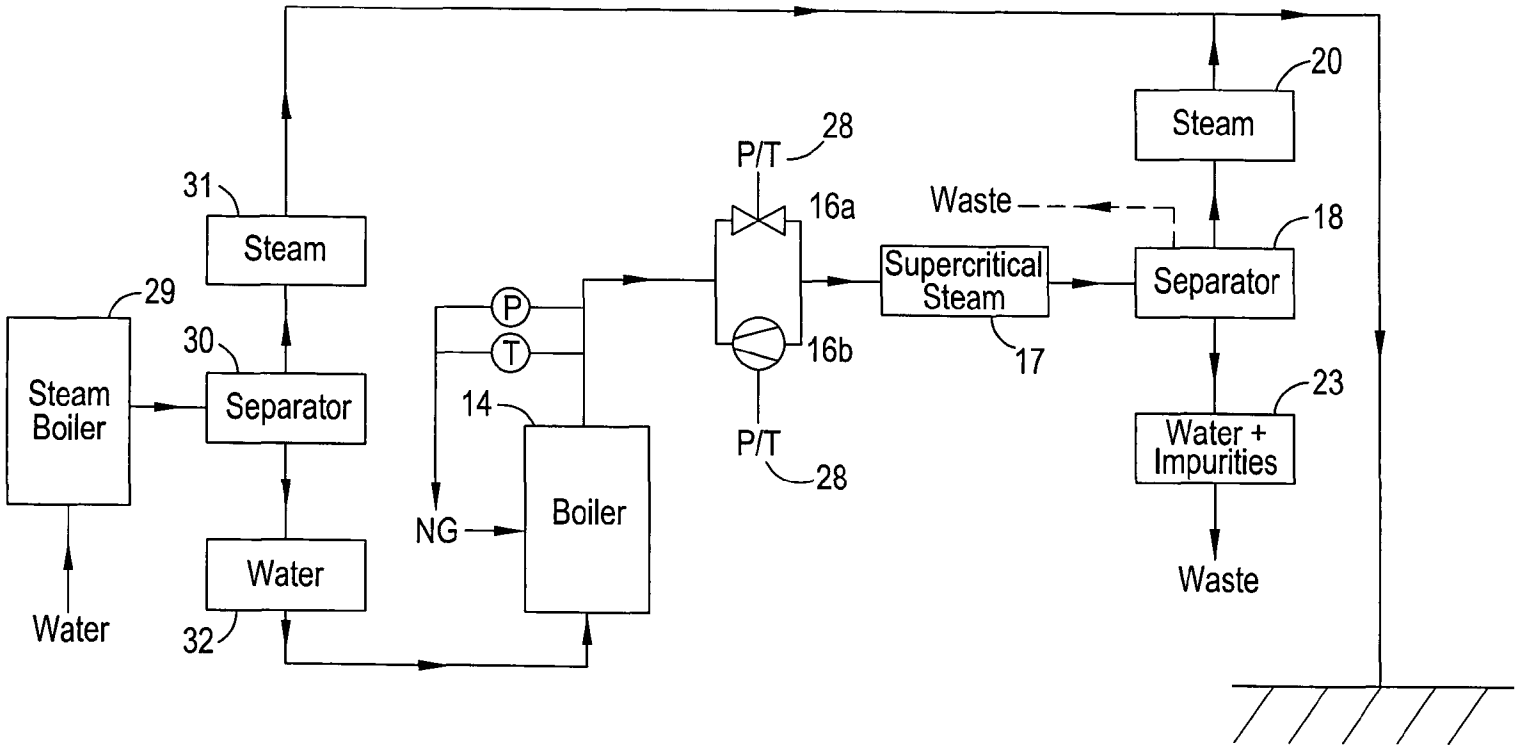
FIG. 3 is a schematic diagram of a further apparatus of the present invention.

In FIGS. 1*b*, 2 and 3 features that are common are designated by the same reference numeral.

Referring to FIG. 1*a*, it shows a schematic diagram of the generation of steam by a conventional technique. Thus water 1, which is generally purified to a significant level, is pumped to a OTSG 2 wherein subcritical steam 3 is generated. Typically the OTSG 2 is operated under conditions that produce a steam quality of about 80%. Under such conditions the steam generator is less likely to run dry which leads to the production of significant amounts of precipitate that sticks to the heat transfer surfaces of the OTSG. The subcritical steam 3 is usually fed to a steam separator 4 to remove the water 5. The resulting dry steam 6 is fed to the hydrocarbon producing system 7 wherein it mobilises hydrocarbon to enable its recovery. When the mobilised hydrocarbon 8 is produced at the surface, significant amounts of water 9 is also produced. This water 9 comprises impurities, e.g. hydrocarbon, silica from the formation and inorganic salts such as carbonates from the formation water. The produced water 9, and optionally the separated water 5, is pumped to a water purifier 10. In the purifier 10 the water is generally separated from organic compounds, e.g. hydrocarbon and then treated to remove impurities. Usually chemical treatments are carried out. The aim of the water purifier 10 is to purify the water to a level to enable it to be used as water 1 for the OTSG. In some cases, however, this is not possible and a proportion of water has to be disposed of as blow down 11. In this case fresh water 12 is used to supplement the water supply 1.

This method has several disadvantages including:

- the quality of steam produced for recovery of hydrocarbon is limited to about 80% which means that 20% of the water supply is not used for steam generation;
- the produced water must be purified to a high level to enable it to be used as supply water;
- similarly the separated water must also be purified to a high level to enable it to be used as supply water or to be disposed of;
- the need to blow down water and concomitantly utilise fresh water has significant environmental impact.

Referring to FIG. 1*b*, it shows a schematic diagram of the generation of steam by a method of the invention. The water 13, which is generally less pure than the water used in conventional steam generation, is pumped to a once-through supercritical steam generator 14. The supercritical steam 15 produced is generally fed to an expansion unit 16 such as a relaxation/expansion valve or turbine. In unit 16 the supercritical steam is converted to subcritical steam 17. The pressure and temperature of the conversion process can be controlled so that subcritical steam of different conditions can be produced. Generally the steam quality is at least 90% by weight. The subcritical steam 17 is fed to a separator 18 where impurities are removed. If the steam is dry, the impurities typically deposit in the separator 18 as solids. More typically, the subcritical steam 17 comprises a percentage of water (e.g. less than 5% by weight) and the impurities are concentrated in the water 19. In the separation the water is separated from the steam thereby purifying the steam. The resulting steam 20 is fed to a hydrocarbon producing system 21 as described above in relation to FIG. 1*a*. In the methods of the invention, however, a much greater volume of the water 13 fed to the steam generator 14 is converted to steam 20 that is injected into the hydrocarbon producing system 21. Moreover, as described above, the degree to which the produced water 23 must be purified to enable it to be utilised as water 13 for the generation of steam is decreased. As a result, little if any water is blown down and much less fresh water, if any, is required.

Referring to FIG. 2, it shows a schematic diagram of an apparatus 25 of the present invention. The apparatus 25 comprises a water inlet 26, preferably fluidly connected to a water tank 27. The inlet 26 supplies water to a once-through supercritical steam generator 14. Any conventional supercritical steam boiler may be used, e.g. a Benson boiler. The supercritical steam 15 that results is fed to an expansion unit 16*a* and or 16*b*, preferably a turbine 16*b*, to convert it to subcritical steam 17. As shown expansion units may be provided in parallel. Alternatively a single expansion unit may be employed. The pressure and temperature of the unit 16 is preferably controlled by controller 28. Energy is released during the conversion of supercritical steam 15 to subcritical steam 17 and this is preferably captured. Optionally the energy is supplied to the once-through supercritical steam generator 14. The subcritical steam 17 is fed to a separator 18 where steam 20 and impurities are separated.

Preferably the impurities are separated in water 23. The resulting steam is then pumped to a hydrocarbon producing system 21.

FIG. 2 also shows how the apparatus of the present invention may be cleaned. The dotted line a indicates a pipe that may be used to convey supercritical steam to an inlet of the supercritical steam boiler 14. $O_2$ may be injected into the supercritical steam as it flows through the pipe so that when the $O_2$-containing supercritical steam enters boiler 14 it combusts any hydrocarbon present therein. The $O_2$ containing supercritical steam is preferably routed out of the boiler 14 via the outlet for supercritical steam. Alternatively a separate outlet (not shown) may be used.

The dotted line b indicates a pipe that may be used to convey $O_2$ containing supercritical steam to the separator 18. The $O_2$ containing supercritical steam preferably passes through both outlets of the separator. Preferably, however, the $O_2$ containing supercritical steam is not injected into the formation. Thus preferably a waste pipe c is provided.

Referring to FIG. 3, it shows a schematic diagram of an apparatus 25 of the present invention. The apparatus comprises a once-through steam generator 14, an expansion unit 16*a* or 16*b* and a separator 18 as shown in FIG. 2. The apparatus shown in FIG. 3, however, additionally comprises a conventional steam boiler 29 that generates subcritical steam. The water fed to this boiler may be water obtained from hydrocarbon recovery operations, fresh water or a mixture thereof. The subcritical steam produced is fed to a separator 30 where steam 31 and water 32 are separated. The water 32 is fed to the once-through steam generator 14. Since the generator 14 generates supercritical steam, there is no need to purify the water 32.

Figure 4:
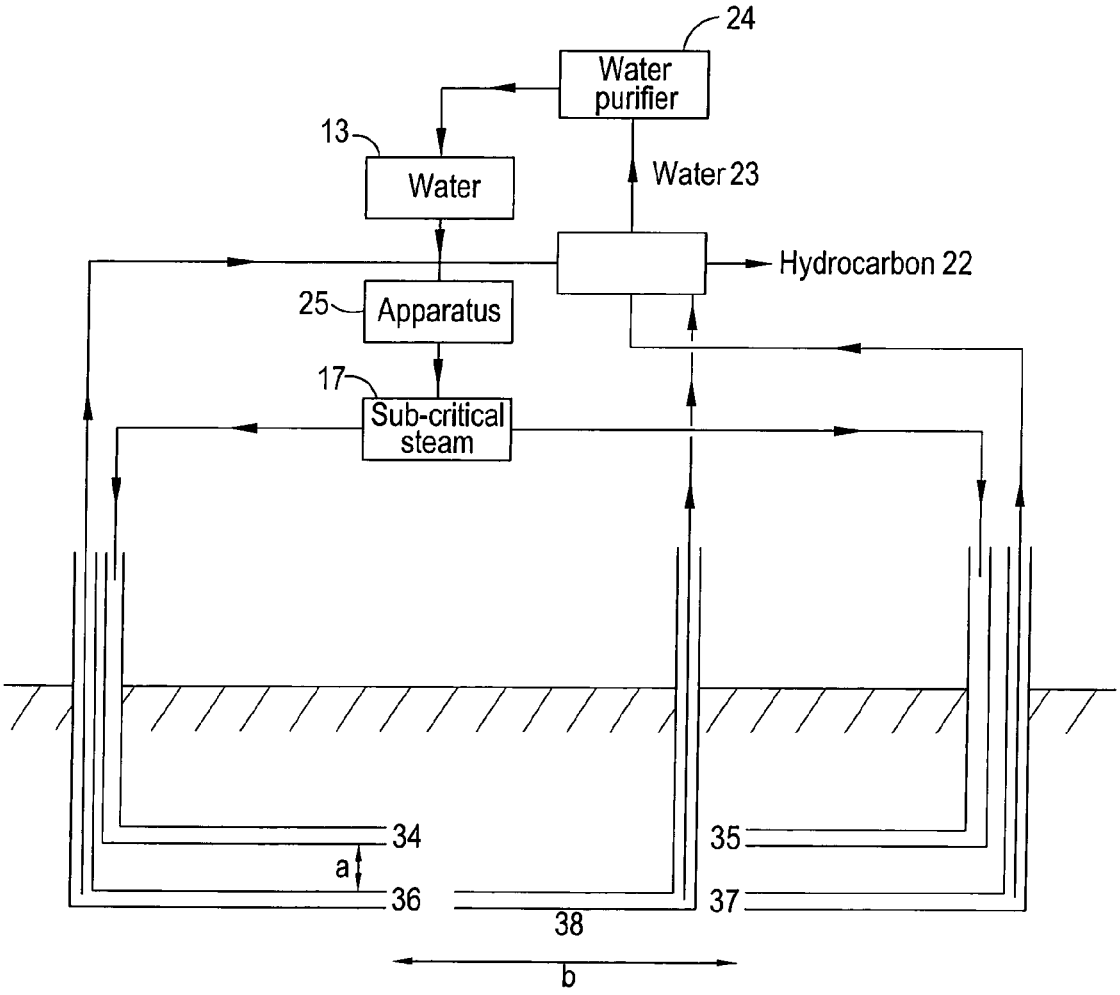
FIG. 4 is a schematic diagram of a system of the present invention.

Referring to FIG. 4, it shows a system 33 for the recovery of hydrocarbon from a hydrocarbon producing system 21. Each SAGD well pair comprises an injector well 34, 35 and a producer well 36, 37. The vertical separation (arrow a) between each well pair is about 5 m. The horizontal separation (arrow b) between each well pair is about 100 m. The injector wells 34, 35 are at the same depth in the reservoir and are parallel to each other. Similarly the producer wells 36, 37 are at the same depth in the reservoir and are parallel to each other. The producer wells 36, 37 are preferably provided with a liner (not shown) as is conventional in the art. The arrangement also preferably includes infill well 38.

Subcritical steam 17 is injected into the hydrocarbon producing system via injection wells 34, 35. This mobilises hydrocarbon and it drains under gravity to producer wells 36, 37 as well as infill well 38. Hydrocarbon is pumped to the surface from these wells where hydrocarbon 22 is separated from produced water 23. The produced water undergoes treatment as hereinbefore described in purifier 24 and thereafter is used to generate steam in apparatus 25.

The invention claimed is:

1. A method of generating steam for the recovery of hydrocarbon from a hydrocarbon producing system comprising:

(i) generating supercritical steam from water;

(ii) converting said supercritical steam to a subcritical steam, wherein said subcritial steam comprises a steam and water mixture;

(iii) separating said subcritical steam into steam and water; and (iv) injecting said subcritical steam into said system.

2. A method as claimed in claim 1, wherein the water used to generate supercritical steam comprises water obtained from hydrocarbon recovery operations.

3. A method as claimed in claim 1, wherein the water used to generate supercritical steam comprises water obtained from hydrocarbon recovery operations and fresh water.

4. A method as claimed in claim 1, wherein the water used to generate supercritical steam comprises less than 10% by volume fresh water.

5. A method as claimed in claim 1, wherein the water used to generate supercritical steam comprises at least one of:

silica 50 ppm wt or higher total dissolved solids 8500 ppm wt or higher hydrocarbon 5 ppm wt or higher $CaCO_3$ 1 ppm wt or higher.

6. A method as claimed in claim 1, wherein said supercritical steam is generated in a once-through steam generator.

7. A method as claimed in claim 1, wherein the pressure of said supercritical steam is in the range 22.2 MPa-50 MPa.

8. A method as claimed in claim 1, wherein the temperature of said supercritical steam is in the range 380-800° C.

9. A method as claimed in claim 1, wherein the conversion of supercritical steam to subcritical steam is carried out in an expansion unit.

10. A method as claimed in claim 9, wherein said unit is a valve or a turbine.

11. A method as claimed in claim 1, wherein impurities are removed from said subcritical steam prior to its injection into said system.

12. A method as claimed in claim 11, wherein said impurities are removed by separation of water from the steam.

13. A method as claimed in claim 1, wherein the pressure of said subcritical steam is in the range 0.5-22.0 MPa.

14. A method as claimed in claim 1, wherein the temperature of said subcritical steam is in the range 150-500° C.

15. A method as claimed in claim 1, wherein the quality of the subcritical steam injected into the formation is at least 80% by volume.

16. A method as claimed in claim 1, wherein the subcritical steam is used in recovery of hydrocarbon by steam assisted gravity drainage.

17. A method of producing hydrocarbon from a hydrocarbon producing system comprising:

(a) generating steam by a method as claimed in claim 1; and (b) using said steam in a method of producing hydrocarbon from said formation.

18. A method as claimed in claim 17, wherein said steam is used to produce hydrocarbon by steam assisted gravity drainage.

19. A method for generating steam for the recovery of hydrocarbon from a hydrocarbon producing system comprising:

(i) generating subcritical steam from water;

(ii) separating said subcritical steam into water and steam;

(iii) generating supercritical steam from said separated water;

(iv) converting said supercritical steam to a subcritical steam;

(v) optionally combining the steam produced in steps (ii) and (iv); and (vi) injecting said subcritical steam into said system.

20. A method as claimed in claim 19, wherein said subcritical steam is generated in step (i) in a once-through steam generator.

21. A method as claimed in claim 19, wherein said subcritical steam is separated in step (ii) in a separator.

22. A method as claimed in claim 19, wherein the water used to generate said subcritical steam in step (i) comprises:
- water obtained from hydrocarbon recovery operations,
- water obtained from hydrocarbon recovery operations and fresh water,
- less than 10% by volume fresh water, or
- at least one of:
  - silica 50 ppm wt or higher
  - total dissolved solids 8500 ppm wt or higher
  - hydrocarbon 5 ppm wt or higher
  - $CaCO_3$ 1 ppm wt or higher.

23. A method as claimed in claim 19, wherein the separated water used to generate supercritical steam in step (iii) is not purified.

24. A method as claimed in claim 19, wherein water obtained from hydrocarbon recovery operations and/or fresh water is added to the separated water and the mixture is used to generate supercritical steam in step (iii).

25. A method as claimed in claim 19, wherein the water used to generate supercrical steam in step (iii) comprises at least one of:
- silica 250 ppm wt or higher
- total dissolved solids 10,000 ppm wt or higher
- hydrocarbon 50 ppm wt or higher
- $CaCO_3$ 10 ppm wt or higher.

26. An apparatus for generating steam for the recovery of hydrocarbon from a hydrocarbon producing system comprising:
- (i) an inlet for water;
- (ii) a supercritical steam boiler connected to said inlet for producing supercritical steam;
- (iii) an expansion unit connected to said supercritical steam boiler for converting said supercritical steam to subcritical steam, wherein said subcritical steam comprises a steam and water mixture;
- (iv) a separator connection to said expansion unit for separating said subcritical steam into steam and water; and
- (v) an outlet connected to said separator for delivery of the steam to said system.

27. An apparatus as claimed in claim 26, wherein said supercritical steam boiler is a once through steam generator.

28. An apparatus as claimed in claim 26, wherein said expansion unit is a valve or a turbine.

29. A system for producing hydrocarbon from a hydrocarbon producing formation comprising:
- (i) an apparatus as claimed in claim 26;
- (ii) a well arrangement connected to said outlet of the apparatus; and
- (iii) a means for the recovery of hydrocarbon.

30. A system as claimed in claim 29, wherein said well arrangement comprises:
- i) a first steam assisted gravity drainage (SAGD) well pair; and
- ii) a second steam assisted gravity drainage (SAGD) well pair.

31. A system as claimed in claim 30, further comprising an infill well, wherein said infill well is located in between said first and second SAGD well pairs.

32. An apparatus for generating steam for the recovery of hydrocarbon from a hydrocarbon producing system comprising:
- (i) an inlet for water;
- (ii) a steam boiler connected to said inlet for producing subcritical steam;
- (iii) a separator connected to said steam boiler for separating water and steam;
- (iv) a supercritical steam boiler connected to said separator for producing supercritical steam from separated water;
- (v) an expansion unit connected to said supercritical steam boiler for converting said supercritical steam to subcritical steam;
- (vi) an outlet connected to said separator for delivery of the steam to said system; and
- (vii) an outlet connected to said expansion unit for delivery of the steam to said system.

33. An apparatus as claimed in claim 32, wherein said steam boiler is a once-through steam generator.

34. An apparatus as claimed in claim 32, wherein said supercritical steam boiler is connected directly to said separator.

* * * * *